US008054280B2

(12) United States Patent
Choi et al.

(10) Patent No.: US 8,054,280 B2
(45) Date of Patent: Nov. 8, 2011

(54) DATA DRIVER WITH BIAS VOLTAGE CONTROL CIRCUIT AND DISPLAY APPARATUS HAVING THE SAME

(75) Inventors: Sung-Pil Choi, Gyeonggi-do (KR); Do-Youn Kim, Gyeonggi-do (KR); Jae-Wook Kwon, Gyeonggi-do (KR); Ki-Won Seo, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 853 days.

(21) Appl. No.: 12/109,288

(22) Filed: Apr. 24, 2008

(65) Prior Publication Data

US 2008/0266276 A1 Oct. 30, 2008

(30) Foreign Application Priority Data

Apr. 24, 2007 (KR) ..... 10-2007-0039875

(51) Int. Cl.
*G09G 3/36* (2006.01)

(52) U.S. Cl. ..... 345/100; 345/204

(58) Field of Classification Search ..... 345/204, 345/98, 100, 87; 327/170
See application file for complete search history.

(56) References Cited

U.S. PATENT DOCUMENTS 6,157,335 A * 12/2000 Suzuki et al. ..... 341/154
6,677,923 B2 * 1/2004 Kajihara et al. ..... 345/89
6,903,589 B2 * 6/2005 Kim ..... 327/170
7,649,392 B2 * 1/2010 Tewinkle et al. ..... 327/170
2004/0212740 A1 * 10/2004 Keller ..... 348/707
2004/0227711 A1 * 11/2004 Kudo et al. ..... 345/87
2005/0057482 A1 * 3/2005 Youngblood et al. ..... 345/100
2006/0279356 A1 * 12/2006 An ..... 330/253

FOREIGN PATENT DOCUMENTS

KR 10-2003-0079179 10/2003
KR 1020030079173 10/2003
KR 10-2004-0017157 2/2004

(Continued)

OTHER PUBLICATIONS

English language abstract of Korean Publication No. 10-2003-0079179.

(Continued)

*Primary Examiner* — Chanh Nguyen
*Assistant Examiner* — John Kirkpatrick
(74) *Attorney, Agent, or Firm* — Myers Bigel Sibley & Sajovec, P.A.

(57) ABSTRACT

A display apparatus including a display driver. The data driver includes a converter to receive and convert image data in digital form into data voltages in analog form, and to provide the data voltages to output buffers. The output buffers receive and buffer the data voltages based on bias voltages generated as part of a feedback path between a bias voltage control circuit and the output buffers. The data voltages are provided to a display part. Before the data voltages output from the output buffers are provided to the display part, the bias voltage control part receives data voltage from the output buffers to count a slew rate of the data voltage, and varies the voltage level of the bias voltage based on the counted result of the slew rate, thereby providing feedback to the output buffers. Accordingly, differences of the slew rate between the data voltages output from the output buffers may be decreased.

16 Claims, 7 Drawing Sheets

FOREIGN PATENT DOCUMENTS

| | | |
|---|---|---|
| KR | 10-2004-0059321 | 7/2004 |
| KR | 10-2004-0064757 | 7/2004 |
| KR | 10-2005-0072574 | 7/2005 |
| KR | 10-2007-0003379 | 1/2007 |

OTHER PUBLICATIONS

English language abstract of Korean Publication No. 10-2004-0017157.

English language abstract of Korean Publication No. 10-2004-0059321.

English language abstract of Korean Publication No. 10-2004-0064757.

English language abstract of Korean Publication No. 10-2005-0072574.

English language abstract of Korean Publication No. 10-2007-0003379.

* cited by examiner

DATA DRIVER WITH BIAS VOLTAGE CONTROL CIRCUIT AND DISPLAY APPARATUS HAVING THE SAME

PRIORITY STATEMENT

This U.S. non-provisional patent application claims priority under 35 U.S.C. §119 of Korean Patent Application No. 10-2007-0039875 filed on Apr. 24, 2007, the entirety of which is hereby incorporated by reference.

BACKGROUND

The present invention is directed to a display apparatus including a data driver. More particularly, the present invention is directed to a display apparatus including a data driver capable of removing slew rate difference among a plurality of output buffers.

A Liquid Crystal Display (LCD) apparatus, which is one of a family of flat panel display apparatuses, has advantages of being smaller, lighter, shorter, thinner, and a consumer of less power. Recently, the LCD has been used widely in laptop computers, television sets, and mobile phones, among other devices.

In general, an LCD apparatus includes an LCD panel, which displays an image. A data driver and a gate driver drive the LCD panel. An LCD panel includes data lines, which receive a data voltage from the data driver, and gate lines, which receive a gate voltage from the gate driver. Pixel domains are defined in the LCD panel by the data lines and the gate lines. A pixel, which includes a thin film transistor (TFT) and pixel electrode, is arranged in each of the pixel domains. The data driver and the gate driver include chips to be mounted on the LCD panel or on separate films.

The data driver includes output buffers, which are coupled to the data lines in one-to-one correspondence, and buffers data voltage transmitted from a D/A converter to provide the data voltage buffered to the data lines. As described above, since the data voltage which drives each pixel of the LCD panel is output through the output buffers, characteristics of the output buffers may have a significant effect on a display quality of the LCD apparatus. The parameters that determine the characteristics of the output buffers are, for example, slew rate, gain, and phase margin.

The slew rate of the output buffers is an especially important factor that determines the display quality of the LCD apparatus. In other words, when a slew rate difference occurs among the output buffers and among the chips that constitute a data driver, vertical lines appear at a boundary portion between the output buffers and the chips where the slew rate difference occurs, which deteriorates the display quality of the LCD apparatus.

SUMMARY

In an exemplary embodiment of the present invention, a data driver includes an input circuit, a converter, an output buffer circuit and a bias voltage control circuit.

The input circuit may receive at least one external digital image data signal. The converter may receive the at least one image data signal from the input circuit, and convert the at least one image data signal into at least one analog data voltage. The output buffer circuit may receive the analog data voltage from the converter, and buffer the analog data voltage responsive to a bias voltage. The bias voltage control circuit may be electrically coupled to the output buffer. A feedback path may be disposed between the output buffer circuit and the bias voltage control circuit.

The bias voltage control circuit may receive the analog data voltage from the output buffer circuit, compare the analog data voltage with a predefined reference voltage so as to count a slew rate of the analog data voltage, and vary a voltage level of the bias voltage based on the counted result of the slew rate.

In another exemplary embodiment according to the present invention, a display apparatus includes a timing control part, a gate driver, a data driver and a display part.

The timing control part may output at least one image data signal in digital form, a gate control signal, and a data control signal. The gate driver part may generate gate voltages responsive to the gate control signal. The data driver part may output data voltages responsive to the data control signal. A display part may display an image corresponding to the data voltage responsive to the gate voltage.

According to the above display apparatus including a data driver, the voltage level of the bias voltage provided from the output buffers included in the data driver may be adjusted according to the slew rate of the data voltage, and the adjusted bias voltage may be fed back to the output buffers. As such, differences in the slew rate between the output buffers may be prevented.

DETAILED DESCRIPTION OF PREFERRED EMBODIMENTS

Figure 1:
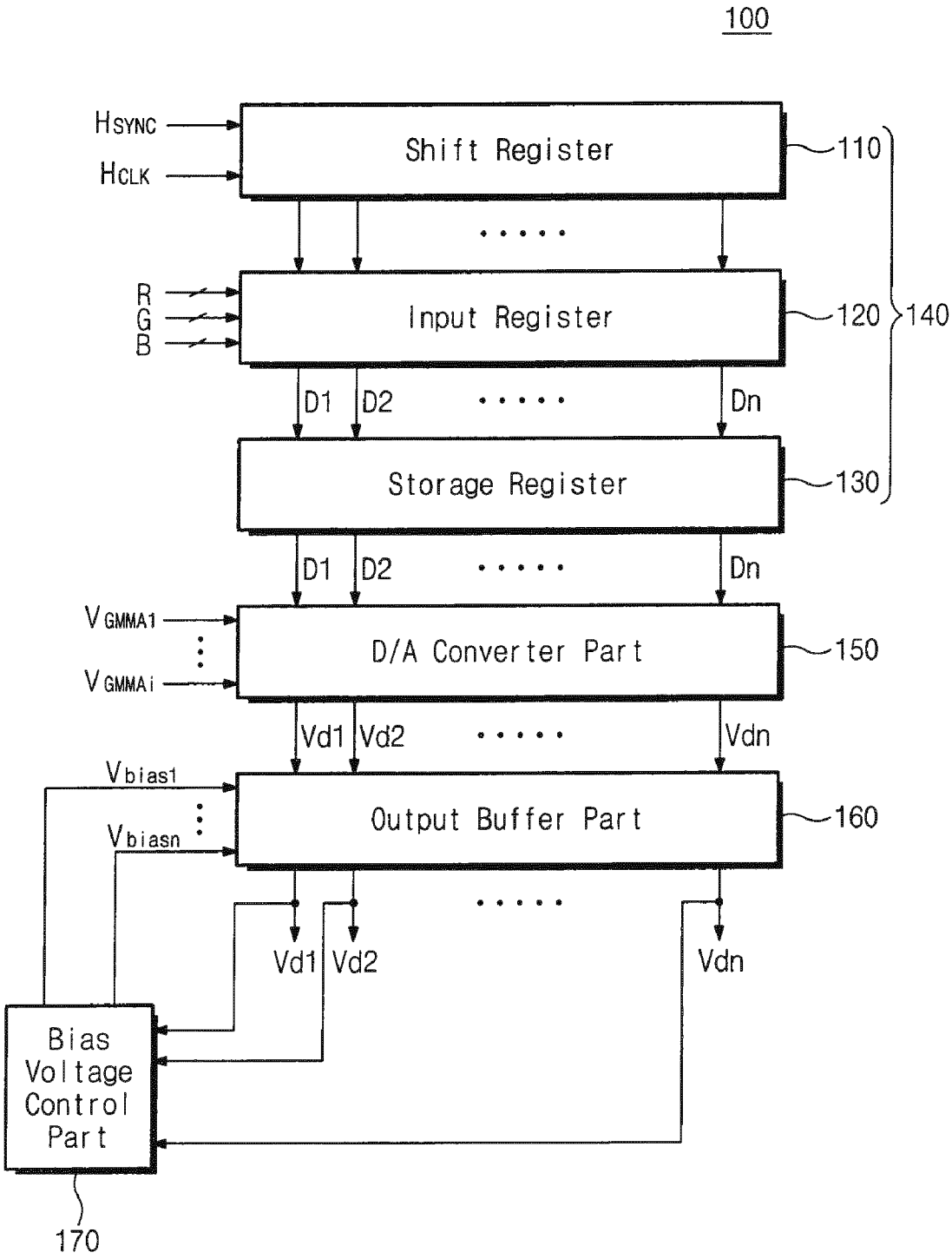
FIG. 1 is a block diagram of a data driver, according to an exemplary embodiment of the present invention.

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, the thicknesses of layers and regions are exaggerated for clarity. It will also be understood that when a layer is referred to as being "on" another layer or substrate, it can be directly on the other layer or substrate, or intervening layers may also be present. Like reference numbers refer to like elements throughout. Exemplary embodiments of the present invention will be described in further detail with reference to the drawings.

FIG. 1 is a block diagram of a data driver, according to an exemplary embodiment of the present invention. Referring to FIG. 1, the data driver 100 may include an input part 140, a D/A converter part 150, an output buffer part 160, and a bias voltage control part 170.

The input part 140 may include a shift register 110, an input register 120 and a storage register 130. The shift register 110 includes a plurality of stages coupled in series, and receives a horizontal synchronous signal Hsync and a horizontal clock signal $H_{CLK}$ from outside of the data driver 100. The shift register 110 starts an operation responsive to the horizontal synchronous signal Hsync, and the plurality of stages may be turned on sequentially to provide a high period of the horizontal clock signal $H_{CLK}$ as an output signal to the input register 120 sequentially.

The input register 120 receives image data signals R, G, and B in digital form from outside of the data driver 100. The input register 120 may sequentially store the image data signals R, G, and B in synchronization with the horizontal clock signal $H_{CLK}$. As a result, a quantity for a line of image data signals (first to $n^{th}$ image data signals; D1-Dn, hereinafter) may be stored in the input register 120. In an exemplary embodiment of the present invention, each of the first to $n^{th}$ image data signals D1-Dn may comprise 10 bits. Then, the first to $n^{th}$ image data signals D1-Dn stored in the input register 120 may be output simultaneously to be stored in the storage register 130.

The D/A converter part 150 receives the first to $n^{th}$ image data signals D1-Dn from the storage register 130, and receives a first to $i^{th}$ gamma reference voltages $V_{GMMA1}$-$V_{GMMAi}$ from outside of the data driver 100. The D/A converter part 150 may convert the first to $n^{th}$ image data signals D1-Dn into first to $n^{th}$ data voltages Vd1-Vdn of an analog form based on the first to $i^{th}$ gamma reference voltages $V_{GMMA1}$-$V_{GMMAi}$.

The first to $n^{th}$ data voltages Vd1-Vdn are provided to the output buffer part 160. The output buffer part 160 may include first to $n^{th}$ OP amplifiers (not shown) which receive the first to $n^{th}$ data voltages Vd1-Vdn, respectively. The first to nth OP amplifiers buffer the first to $n^{th}$ data voltages Vd1-Vdn based on first to $n^{th}$ bias voltages Vbias1-Vbiasn respectively.

The bias voltage control part 170 may receive the first to $n^{th}$ data voltages Vd1-Vdn buffered from the output buffer part 160, and compare the first to $n^{th}$ data voltages Vd1-Vdn with a predefined reference voltage. The bias voltage control part 170 counts the slew rates of the first to $n^{th}$ OP amplifiers included in the output buffer part 160 based on the compared result, and controls the voltage levels of the first to $n^{th}$ bias voltages Vbias1-Vbiasn provided to the first to $n^{th}$ OP amplifiers in accordance with a count number.

When the count number is higher than a predefined value, the count number which corresponds to the slew rate of the data voltage output from the corresponding OP amplifier, a voltage level of the bias voltage provided to the corresponding OP amplifier is raised, and when the count number is lower than the predefined value, the voltage level of the bias voltage is lowered. Accordingly, the slew rate difference among the first to $n^{th}$ data voltages Vd1-Vdn output from the first to $n^{th}$ OP amplifiers may be decreased.

Figure 2:
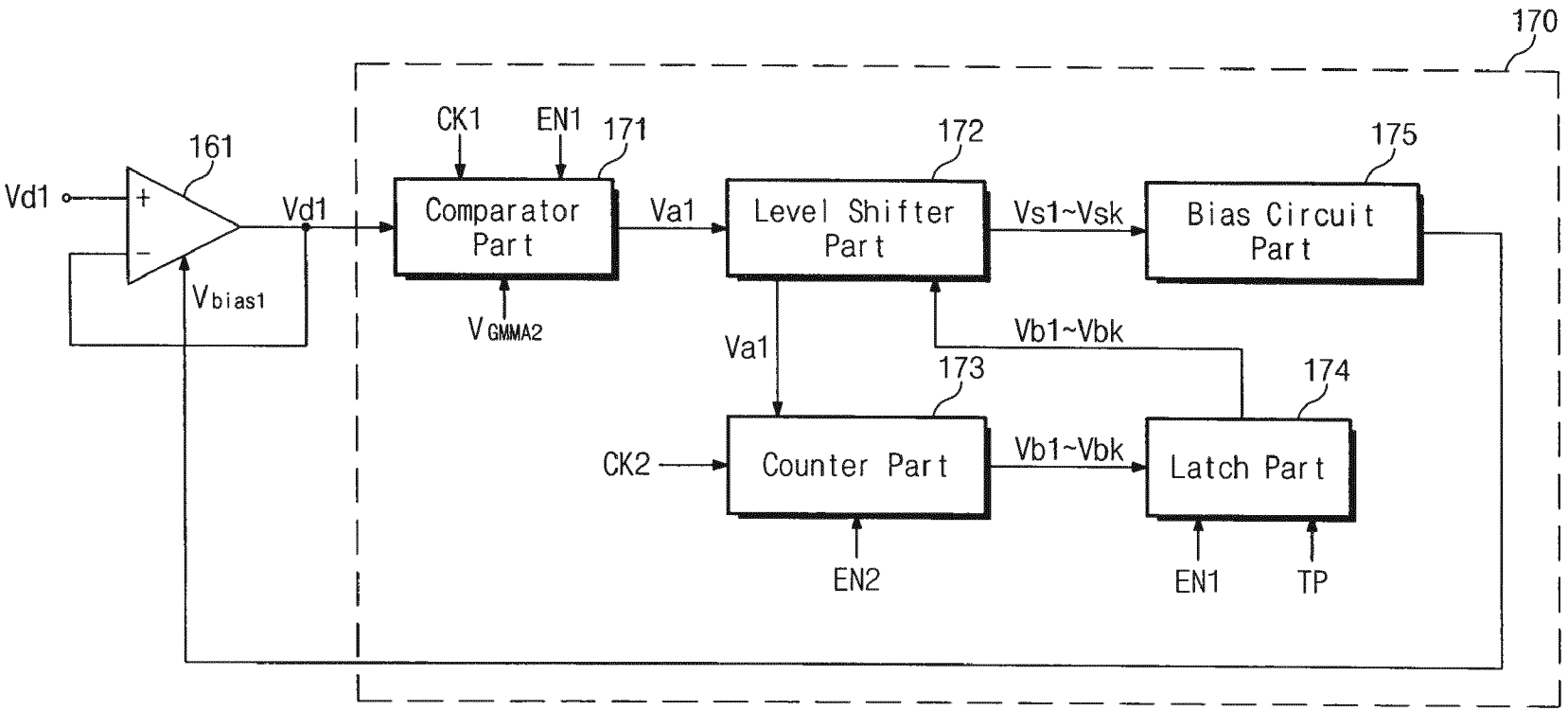
FIG. 2 is a block diagram of the bias voltage control part illustrated in FIG. 1.

FIG. 2 is a block diagram of the bias voltage control part illustrated in FIG. 1. Referring to FIG. 2, a bias voltage control part 170 may include bias voltage control units coupled having a one-to-one correspondence with a first OP amplifier 161 to $n^{th}$ OP amplifiers (not shown) of the output buffer part 160. Because each of the bias voltage control units is formed in the same structure, a first bias voltage control unit coupled to the first OP amplifier 161 will be described with reference to FIG. 2, and a description of the other bias voltage control units will be omitted for brevity.

As illustrated in FIG. 2, the first bias voltage control unit may include a comparator part 171, a level shifter part 172, a counter part 173, a latch part 174, and a bias circuit part 175. The comparator part 171 may receive a first data voltage Vd1 output from the first OP amplifier 161 and a predefined reference voltage, and may compare the first data voltage Vd1 and the predefined reference voltage to output a first comparison voltage Va1. The reference voltage may be defined as a voltage corresponding to a middle point of the maximum rising period of the data voltage. The comparator part 171 may receive one gamma reference voltage selected from the first to $i^{th}$ gamma reference voltages $V_{GMMA1}$-$V_{GMMAi}$, as the predefined reference voltage. In an exemplary embodiment of the present invention, the second gamma reference voltage $V_{GMMA2}$ may be provided as the reference voltage of the comparator part 171.

The comparator part 171 may receive the first data voltage Vd1 from the first OP amplifier 161 responsive to a first clock CK1 and a first enabling signal EN1. The first data voltage Vd1 transmitted from the comparator part 171 may be compared with the second gamma reference voltage $V_{GMMA2}$, which is the reference voltage. The comparator part 171 outputs the first comparison voltage Va1 of which the voltage level varies according to the compared result.

The first comparison voltage Va1 is provided to the level shifter part 172. The level shifter part 172 levels down the first comparison voltage Va1 to provide the first leveled down comparison voltage Va1 to the counter part 173. The counter part 173 may be turned on responsive to the second enabling signal EN2, and may count the high period of the first leveled down comparison voltage Va1 by using the second clock CK2. When the counter part 173 includes a j-bit counter, the counter part 173 may output a first to $k^{th}$ counting voltages Vb1-Vbk, and transmit to the latch part 174 the first to $k^{th}$ counting voltages Vb1-Vbk, which correspond to a count number of the high period of the first leveled down comparison voltage Va1. In an exemplary embodiment of the present invention, the 'k' is equal to the value of '$2^j$'.

The latch part 174 may latch the first to $k^{th}$ counting voltages Vb1-Vbk provided from the counter part 173 responsive to the first enabling signal EN1 and an output start signal TP and may supply the first to $k^{th}$ counting voltages Vb1-Vbk to the level shifter part 172. The level shifter part 172 boosts the first to $k^{th}$ counting voltages Vb1-Vbk to first to $k^{th}$ switching voltages Vs1-Vsk and provides the first to $k^{th}$ switching voltages Vs1-Vsk to the bias circuit part 175.

The bias circuit part 175 may output a first bias voltage Vbias1 having a voltage level corresponding to the count number, responsive to the first to $k^{th}$ switching voltages Vs1-Vsk. The first bias voltage Vbias1 output from the bias circuit part 175 may be provided to the first OP amplifier 161. In particular, as the count number corresponding to the slew rate of the first data voltage Vd1 increases, the first bias voltage Vbias1 is leveled down, and as the count number decreases, the first bias voltage Vbias1 is leveled up.

As such, the first bias voltage Vbias1 is controlled in accordance with the slew rate of the first data voltage Vd1 output from the first OP amplifier 161, and the first OP amplifier 161 receives feedback of the controlled first bias voltage Vbias1 and adjusts the slew rate of the first data voltage Vd1 to the predefined reference value. Accordingly, the slew rate of the OP amplifier included in the data driver 100 may be maintained at the reference value, and the slew rate difference among the plurality of OP amplifiers included in the data driver 100 may be removed.

Figure 3:
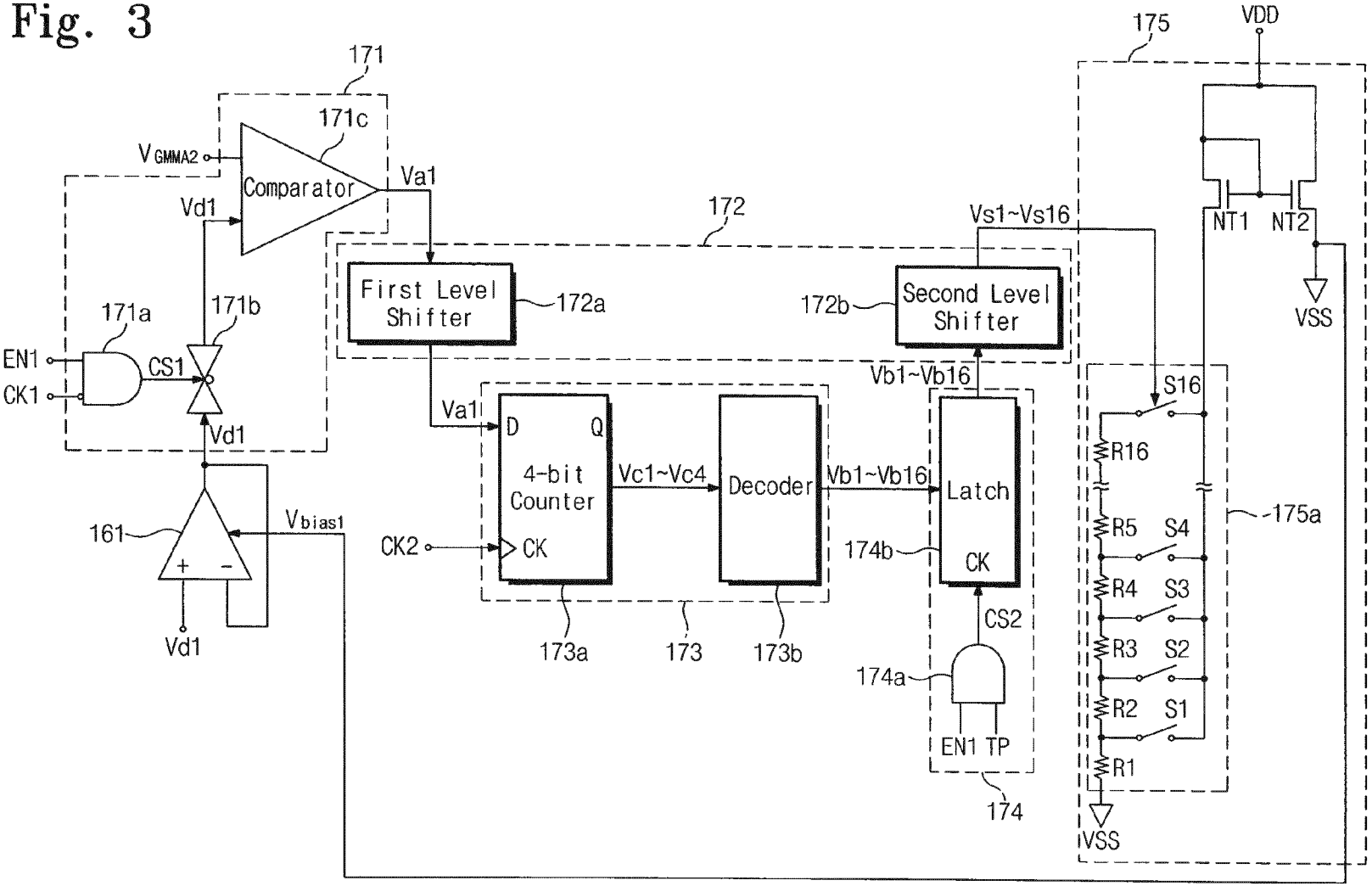
FIG. 3 is detailed block diagram of the bias control part illustrated in FIG. 2.
Figure 4:
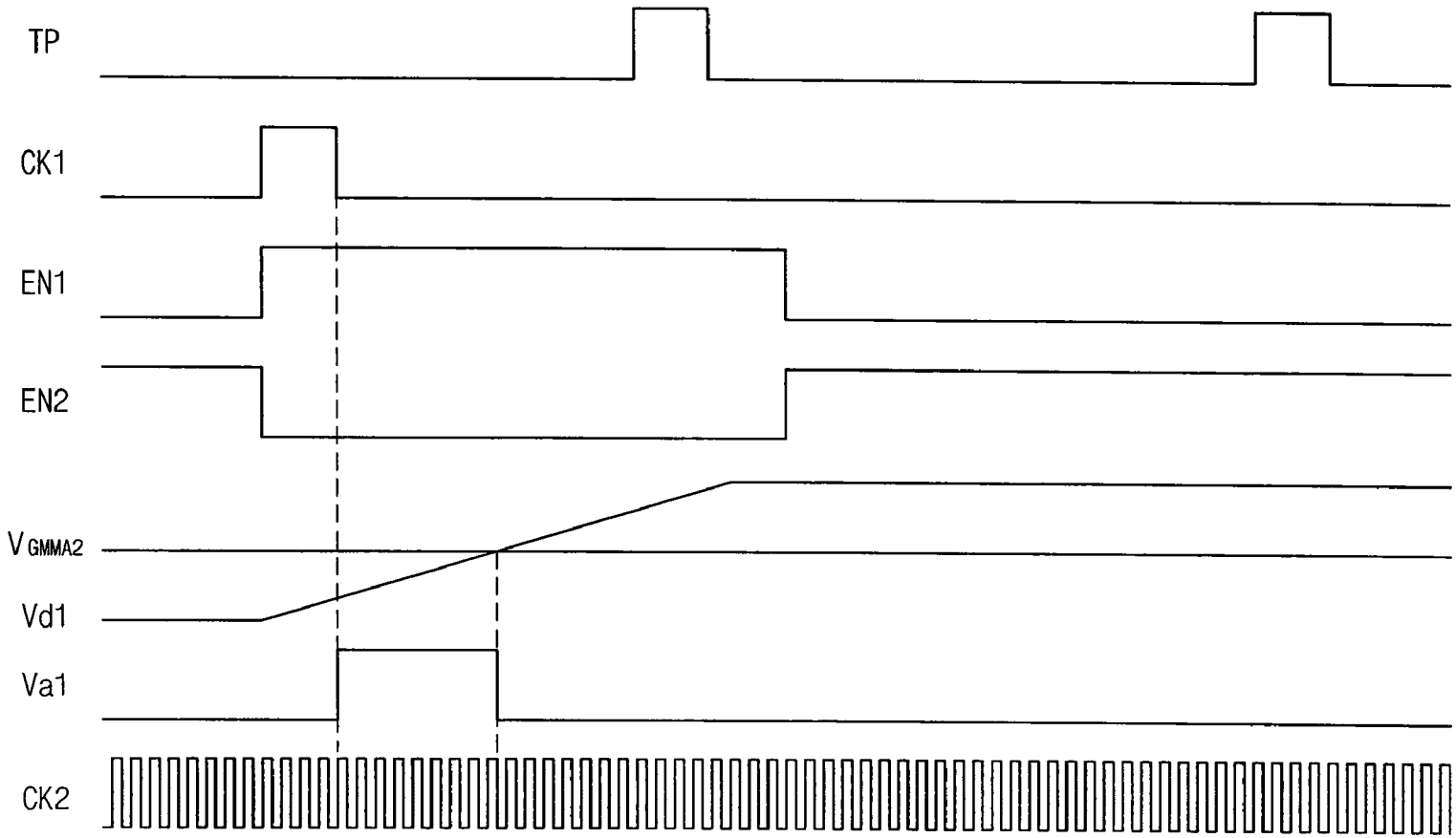
FIG. 4 is a wavelet diagram of the signals illustrated in FIG. 3.

FIG. 3 is a more detailed block diagram of the bias voltage control part of FIG. 2. FIG. 4 is a wavelet diagram of the signals illustrated in FIG. 3.

Referring to FIG. 3 and FIG. 4, a comparator part 171 in the bias voltage control part 170 (of FIG. 2) may include a first end gate 171*a*, a transmission gate 171*b*, and a comparator 171*c*. The first end gate 171*a* may receive a signal converted from the first clock CK1 and a first enabling signal EN1 and output a first control signal CS1. The transmission gate 171*b* transmits the first data voltage Vd1 output from the first OP amplifier 161 to the comparator 171*c* responsive to the first control signal CS1.

The comparator 171*c* may receive the first data voltage Vd1 and a second gamma reference voltage $V_{GMMA2}$, which is the predefined reference voltage, and compares the first data voltage Vd1 and the second gamma reference voltage $V_{GMMA2}$. As a result, the comparator 171*c* outputs a comparison voltage Va1 having a high level in a period where the first data voltage Vd1 is lower than the second gamma reference voltage $V_{GMMA2}$ and the low level in a period where the first data voltage Vd1 is higher than the second gamma reference voltage $V_{GMMA2}$.

The high period of the comparison voltage Va1 varies according to the slew rate of the first data voltage Vd1. In other words, when the slew rate of the first data voltage Vd1 is increased, the rising time of the first data voltage Vd1 decreases, which results in shortening of the high period of the comparison voltage Va1. On the other hand, when the slew rate of the first data voltage Vd1 is decreased, the rising time of the first data voltage Vd1 increases, which results in lengthening of the high period of the comparison voltage Va1.

The level shifter part 172 of the bias voltage control part 170 includes a first level shifter 172*a* and a second level shifter 172*b*. The first level shifter 171*a* levels down the comparison voltage Va1 output from the comparator 171*c*. Then, the leveled down comparison voltage Va1 is provided to the counter part 173.

The counter part 173 includes a 4-bit counter 173*a* and a decoder 173*b*. The 4-bit counter 173*a* may be enabled responsive to the converted signal from the second enabling signal EN2, and counts the high period of the leveled down comparison voltage Va1 based on the second clock CK2. In an exemplary embodiment of the present invention, the second enabling signal EN2 is a converted signal from the first enabling signal EN1, and the second clock CK2 has a lower frequency than the horizontal clock signal $H_{CLK}$ illustrated in FIG. 1.

In the exemplary embodiment of the present invention, supposing that the difference of rising times of the data voltages between the OP amplifiers provided in the data driver 100 is generated at 200 ns maximum, in order to count the rising times of each of the data voltages, the horizontal clock signal $H_{CLK}$ may be divided to generate the second clock CK2 having a frequency of about 54 MHz. The second clock CK2 may then be provided to the 4-bit counter 173*a*.

The 4-bit counter 173*a* may count the high period of the leveled down comparison voltage Va1 using the second clock CK2, and output first to fourth counting voltages Vc1-Vc4 corresponding to the count number. The decoder 173*b* may receive the first to fourth counting voltages Vc1-Vc4 to decode the first to fourth counting voltages Vc1-Vc4 into first to $16^{th}$ voltages Vb1-Vb16 and provide the first to $16^{th}$ voltages Vb1-Vb16 to the latch part 174.

The latch part 174 may include a second end gate 174*a* and a latch 174*b*. The second end gate 174*a* receives a first enabling signal EN1 and an output start signal TP to output a second control signal CS2. Here, the output start signal TP is a signal controlling a point in time when the first to $n^{th}$ data voltages are output from the data driver 100. The high period of the output start signal TP may be generated in the high period of the first enabling signal EN1.

The latch 174*b* may store the first to $16^{th}$ voltages Vb1-Vb16 input from the decoder 173*b*, and sequentially output the first to $16^{th}$ voltages to the second level shifter 172*b* based on the output start signal TP. The second level shifter 172*b* levels up the voltage levels of the first to $16^{th}$ voltages Vb1-Vb16, and converts the first to $16^{th}$ voltages Vb1-Vb16 leveled up into first to $16^{th}$ switching voltages Vs1-Vs16. The first to $16^{th}$ switching voltages Vs1-Vs16 may then be output from the second level shifter 172*b*.

The bias circuit part 175 may include a first and a second NMOS transistor NT1 and NT2 coupled to each other in a current mirror form, and a resistance part 175*a* coupled to an output terminal of the first NMOS transistor NT1. The resistance part 175*a* may include first to $16^{th}$ switches S1-S16, and first to $16^{th}$ resistive elements R1-R16 coupled in series. Here, the sizes of each of the first to $16^{th}$ resistive elements R1-R16 may be substantially equal.

The first to $16^{th}$ switching voltages Vs1-Vs16 output from the second level shifter 172*b* may be transferred to the first to $16^{th}$ switches S1-S16 of the resistance part 175*a*, respectively and control on/off operations of the first to $16^{th}$ switches S1-S16. In other words, by controlling the on/off operations of the first to $16^{th}$ switches S1-S16 based on the count number output from the 4-bit counter 173*a*, the total resistance value of the resistance part 175*a* is determined. For example, if the count number output from the 4-bit counter 173*a* is 16, the first to $16^{th}$ switches S1-S16 are all turned on and the total resistance value of the resistance part 174*a* is determined by the sum of the first to $16^{th}$ resistive elements R1-R16. If the count number is 10, the first to $10^{th}$ switches S1-S10 are turned on and the total resistance of the resistance part 175*a* is determined by the sum of the first to $10^{th}$ resistive elements R1-R10.

Suppose that each of the resistive elements R1-R16 has a resistance value of 2 kΩ. When the first to $16^{th}$ switches S1-S16 are all turned on, the resistance part 175*a* would therefore have a 32 kΩ maximum resistance. When the first to $10^{th}$ switches S1-S10 are turned on, the resistance part 174*a* would have a resistance value of 20 kΩ. In the exemplary embodiment of the present invention, a standard resistance value of the resistance part 175*a* can be predefined or set at 20 kΩ so that a "normal" count number corresponding to the slew rate of the first data voltage Vd1 is 10.

However, a different number from the normal count number (i.e., 10) may be generated responsive to the slew rate of the first data voltage Vd1 output from the first OP amplifier 161. For example, if the count number is output as 9, the slew rate of the first data voltage Vd1 has a larger value than a normal value. Accordingly, the resistance part 175*a* outputs a resistance value corresponding to 9 counting number of times, i.e., it outputs a resistance value of 22 kΩ, which is larger than the standard resistance value 20 kΩ. The voltage level of the first bias voltage Vbias1 output from the bias circuit part 175 is raised to a voltage level corresponding to the resistance value of 22 kΩ. The first bias voltage Vbias1 output from the bias control part 175 is fed back to the first OP amplifier 161 to control the first OP amplifier 161 so that the first data voltage Vd1 output from the first OP amplifier 161 may have a normal slew rate.

Meanwhile, when a number 11 is output, which is larger than the normal count number 10, i.e., the count number corresponding to the slew rate of the first data voltage Vd1 output from the first OP amplifier 161, the slew rate of the first data voltage Vd1 has a smaller value than a normal value. Accordingly, the resistance part 175*a* outputs a resistance value corresponding to a count number 11, i.e., a resistance value of 18 kΩ which is smaller than the standard resistance value 20 kΩ. The voltage level of the first bias voltage Vbias1 output from the bias circuit part 175 decreases to a voltage level corresponding to the resistance value of the 18 kΩ. The first bias voltage Vbias1 output from the bias circuit part 175 is fed back to the first OP amplifier 161 to control the first OP amplifier 161 so that the first data voltage Vd1 output from the first OP amplifier 161 may have a normal slew rate.

As shown in FIG. 1 to FIG. 4, the data driver 100 measures a count number corresponding to the slew rate of the data voltage output from the OP amplifier by using the bias voltage control part 170. Also, the data driver 100 controls the voltage level of the bias voltage using the resistance value corresponding to the measured count number, and provides a feedback loop to the OP amplifier. By these processes, the data driver 100 may be controlled so that the data voltage output from the OP amplifier may have a normal slew rate. As such, the difference of the slew rate among the OP amplifiers provided in the data driver 100 may be removed.

Figure 5:
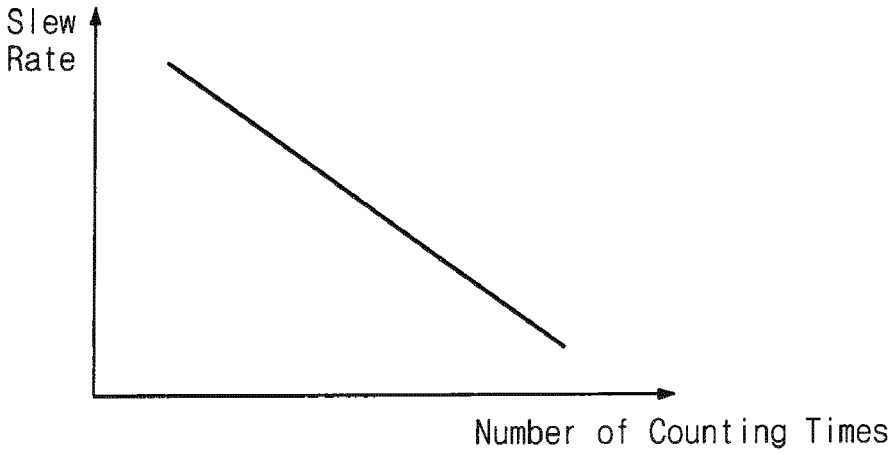
FIG. 5 is a graph illustrating a relationship between a count number and a slew rate.
Figure 6:
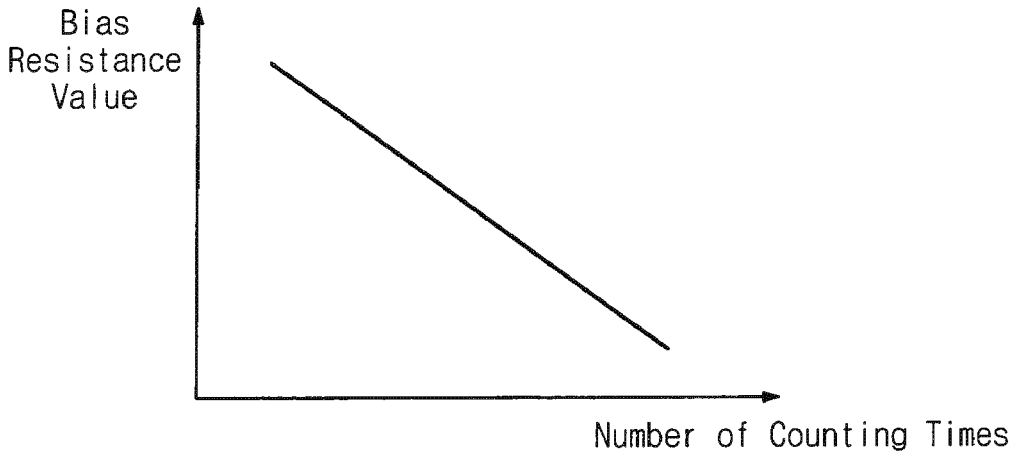
FIG. 6 is a graph illustrating a relationship between the count number and a bias resistance value.
Figure 7:
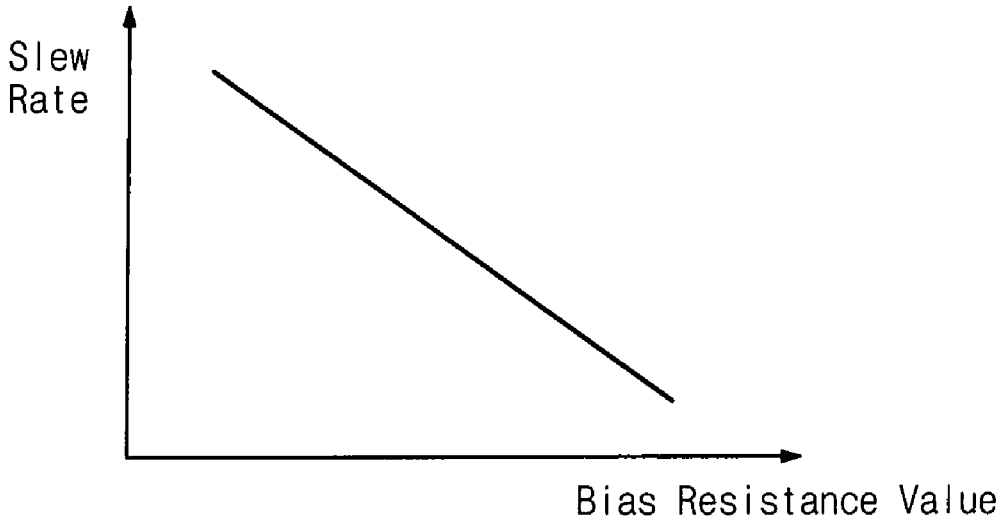
FIG. 7 is a graph illustrating a relationship between the bias resistance value and the slew rate.

FIG. 5 is a graph illustrating a relationship between the count number and the slew rate. FIG. 6 is a graph illustrating a relationship between the count number and the bias resistance. FIG. 7 is a graph showing a relationship between the bias resistance and the slew rate. In FIG. 5, an x-axis represents the count number and a y-axis represents the slew rate. In FIG. 6, an x-axis represents the count number and a y-axis represents the bias resistance. In FIG. 7, an x-axis is the bias resistance and a y-axis is the slew rate.

As shown in FIG. 5, the slew rate increases as the rising time of the data voltage output from the OP amplifier decreases. Therefore, the slew rate of the data voltage decreases as the count number output from the 4-bit counter increases. When the slew rate of the data voltage output from the OP amplifier is higher than a normal value, the count number decreases below the count number corresponding to the normal slew rate. Adversely, when the slew rate of the data voltage output from the OP amplifier is lower than the normal value, the count number increases above the count number corresponding to the normal slew rate.

Referring to FIG. 6, the resistance value of the bias circuit part decreases as the count number output from the 4-bit counter increases. If the count number is higher than the normal count number, the resistance value of the bias circuit part decreases, and if the count number is lower than the normal count number, the resistance value of the bias circuit part increases.

As shown in FIG. 7, as the resistance value of the bias circuit part increases, the slew rate decreases. Therefore, in order to decrease the slew rate of the data voltage output from the OP amplifier, the resistance value of the bias circuit part is raised. Also in order to increase the slew rate of the data voltage output from the OP amplifier, the resistance value of the bias circuit part is reduced.

Before the data voltage is output from the data driver 100 (see FIG. 1), it should be determined whether the slew rate of the data voltage output from the OP amplifier is output normally, and according to its result, the voltage level of the bias voltage fed back from the OP amplifier is controlled. Therefore, any difference of the slew rate among the data voltages output from the data driver 100 may be removed.

Figure 8:
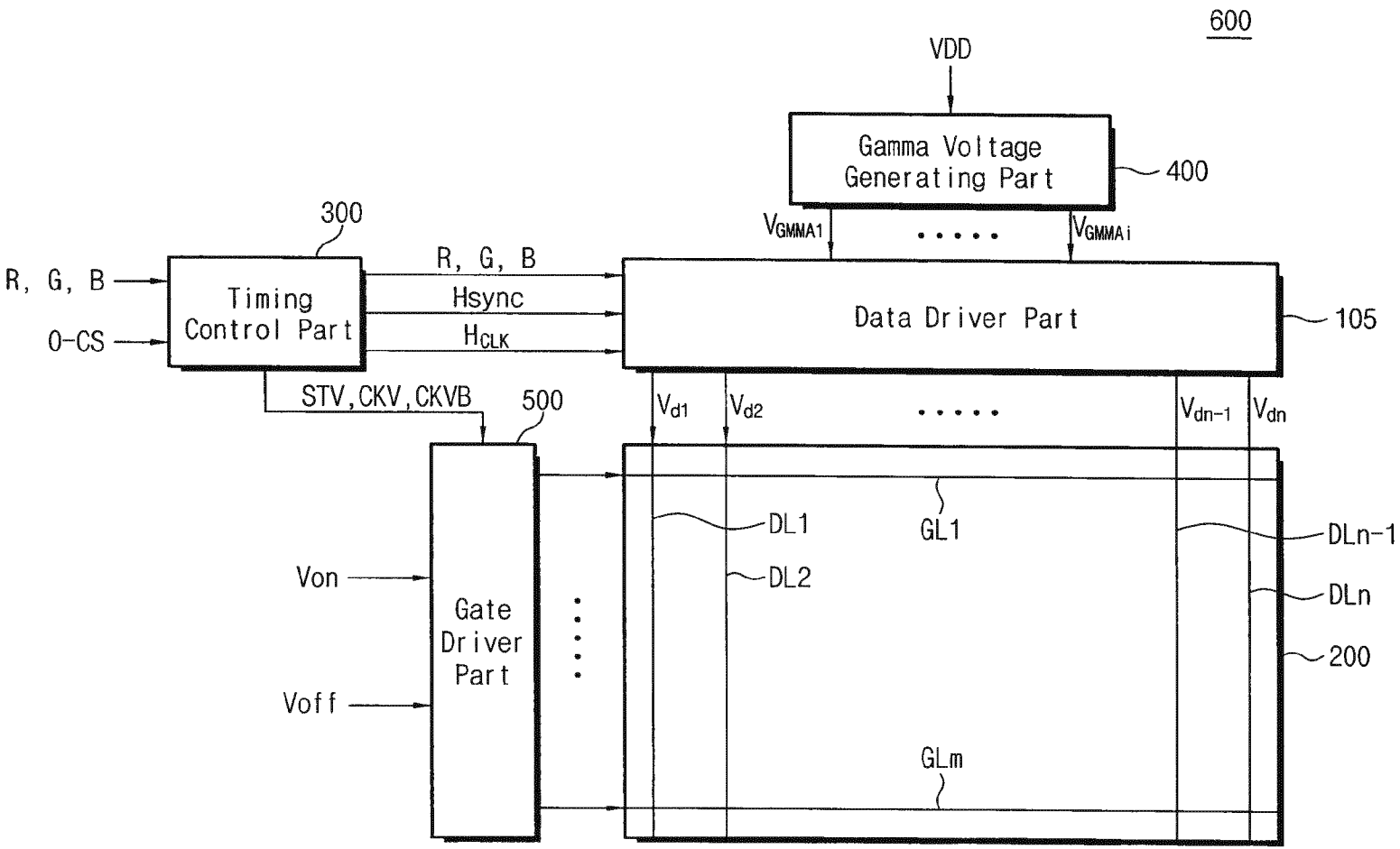
FIG. 8 is a block diagram of the liquid crystal display apparatus, according to another exemplary embodiment of the present invention.

FIG. 8 is a block diagram of a Liquid Crystal Display apparatus according to another exemplary embodiment of the present invention. Referring to FIG. 8, the LCD apparatus 600 includes a timing control part 300, a data driver part 105, a gamma voltage generating part 400, a gate driver part 500, and a display part 200.

The timing control part 300 receives image data signals R, G, and B in a digital form and control signals 0-CS from an exterior device. The timing control part 300 may provide the image data signals R, G, and B to the data driver part 105 using a Reduced Swing Differential Signal (RSDS) transmitting method. The timing control part 300 may output control signals (e.g., horizontal synchronous signal Hsync, horizontal clock signal $H_{CLK}$, vertical start signal STV, clock CKV, and clock bar signal CKVB) required to operate the data driver part 105 and the gate driver part 500, based on the control signals 0-CS.

The gamma voltage generating part 400 may comprise a resistance string structure, and may receive a drive voltage VDD to output a first to $i^{th}$ gamma reference voltages $V_{GMMA1}$-$V_{GMMAi}$, which are increased to an equal voltage level sequentially. The first to $i^{th}$ gamma reference voltages $V_{GMMA1}$-$V_{GMMAi}$ output from the gamma reference voltage generating part 400 are provided to the data driver part 105.

The horizontal synchronous signal Hsync and the horizontal clock signal $H_{CLK}$ generated in the timing control part 300 are supplied to the data driver part 105, and the data driver part 105 receives the image data signals R, G, and B from the timing controller 300 in synchronization with the horizontal synchronous signal Hsync and the horizontal clock signal $H_{CLK}$. The data driver part 105 receives a quantity for a line of image data signals R,G, and B (a quantity for a line of image data signals is n number of image data signals) from the timing control part 300 to output n number of data voltages.

The data driver part 105 may be substantially the same structure as the data driver 100 of FIG. 1. Therefore, a detailed description of the data driver part 105 illustrated in FIG. 8 will be omitted for brevity.

The gate driver part 500 may include a shift register, which starts operation responsive to the vertical start signal STV. Each stage of the shift register is sequentially turned on responsive to the clock CKV and clock bar signal CKVB. The gate driver part 500 may sequentially output a gate signal having a gate-on voltage substantially equal to a Von level.

The display part 200 may include two substrates and an LCD panel (not shown). The LCD panel may comprise a liquid crystal layer interposed between the two substrates to display an image. On one of the two substrates, first to $n^{th}$ data lines DL1-DLn may be disposed, and first to $m^{th}$ gate lines GL1-GLm may also be disposed. The first to $n^{th}$ data lines DL1-DLn intersect with and are insulated from the first to $m^{th}$ gate lines GL1-GLm. On the substrate, pixel regions are defined in a matrix form by the first to $n^{th}$ data lines DL1-DLn and a first to $m^{th}$ gate lines GL1-GLm.

Pixels are provided in the pixel regions in a one-to-one correspondence arrangement. For example, each pixel receives the corresponding data voltage responsive to the corresponding gate signal. The penetration rate of the liquid crystal layer is controlled according to the voltage level of the data voltage. As a result, an image having a desired gray level may be displayed.

The data driver part 105 may comprise data drive chips, which are mounted directly on the liquid crystal display panel, or mounted on a film (not shown) attached to the liquid crystal display panel. As shown in FIG. 1 to FIG. 4, a bias voltage control part may be provided in the data drive chips according to embodiments of the present invention. The bias voltage control part measures the slew rate of the data voltages output from an OP amplifier, and controls the voltage level of the bias voltage corresponding to the measured slew rate by creating a feedback loop to the OP amplifier. The bias voltage control part controls the slew rate of the data voltages output from the OP amplifier responsive to the predefined standard value. As such, differences of the slew rate between the OP amplifiers and the data drive chips are prevented.

In some exemplary embodiments of the present invention, the bias voltage may be generated based on the measured slew rate and fed back to the OP amplifier, and may be refreshed responsive to the vertical start signal STV. In other words, the bias voltage may be refreshed in one frame unit. In this case, the first enabling signal EN1 provided to the comparator part 171 and latch part 174 of FIG. 2 may have an equal frequency with that of the vertical start signal.

Meanwhile, the bias voltage may be refreshed in more than one horizontal line (i.e., gate line) unit. In some embodiments, the frequency of the first enabling signal may vary according to the number of horizontal lines refreshed.

According to the above display apparatus including a data driver, a bias voltage control part is provided. The bias voltage control part controls the voltage level of the bias voltage provided to the output buffers of the data driver, according to the slew rate of the data voltage output from the output buffers. And the bias voltage control part feeds back the controlled bias voltage to the output buffers.

Accordingly, the difference of the slew rate generated among the output buffers may be decreased. Vertical lines that appear in the border line area between the output buffers from difference of slew rate may be prevented, which results in improved general display quality of a display apparatus.

Although the present invention has been described in connection with the embodiment of the present invention illustrated in the accompanying drawings, it is not limited thereto. It will be apparent to those skilled in the art that various substitution, modifications and changes may be thereto without departing from the scope and spirit of the invention.

What is claimed is:

1. A data driver comprising:

an input circuit structured to receive at least one external digital image data signal;

a converter electrically coupled to the input circuit and structured to receive the at least one image data signal from the input circuit, and to convert the at least one image data signal into at least one analog data voltage;

an output buffer circuit electrically coupled to the converter and structured to receive the analog data voltage from the converter, and to buffer the analog data voltage responsive to at least one bias voltage;

a bias voltage control circuit electrically coupled to the output buffer; and a feedback path between the output buffer circuit and the bias voltage control circuit, wherein the bias voltage control circuit is structured to receive the analog data voltage from the output buffer circuit, to compare the analog data voltage with a predefined reference voltage so as to count a slew rate of the analog data voltage, and to vary a voltage level of the at least one bias voltage based on the counted result of the slew rate, and wherein the bias voltage control circuit comprises:

a comparator structured to compare the analog data voltage and the reference voltage responsive to a first clock and a first enabling signal, and to output a comparison voltage corresponding to the compared result;

a first level shifter structured to level down the comparison voltage;

a counter structured to receive the leveled down comparison voltage, to count a number of a high period of the comparison voltage responsive to a second clock and a second enabling signal, and to output first to $k^{th}$ voltages corresponding to the count number;

a latch structured to latch the first to $k^{th}$ voltages output from the counter responsive to an output start signal and the first enabling signal;

a second level shifter structured to level up the first to $k^{th}$ voltages output from the latch to output first to $k^{th}$ switching voltages; and a bias circuit structured to control a voltage level of the at least one bias voltage responsive to the first to $k^{th}$ switching voltages, and to feedback the at least one bias voltage to the output buffer circuit.

2. The data driver of claim 1, wherein the comparator comprises:

an end gate structured to receive the first clock and the first enabling signal to output a first control signal;

a transmitting gate structured to output the analog data voltage from the output buffer circuit responsive to the first control signal; and a comparator structured to receive the analog data voltage from the transmitting gate, to compare the predefined reference voltage and the analog data voltage to output the comparison voltage, the comparison voltage having a high level in a period where the analog data voltage is lower than the reference voltage and having a low level in a period where the analog data voltage is higher than the reference voltage.

3. The data driver of claim 2, wherein the first clock is generated in a high period of the first enabling signal, and the first clock and the first enabling signal have an equal frequency level.

4. The data driver of claim 1, wherein the counter comprises:

a j-bit counter structured to be enabled responsive to the second enabling signal, the j-bit counter structured to count the high period of the comparison voltage using the second clock to output first to $j^{th}$ counting voltages, the first to $j^{th}$ counting voltages including the count number; and a decoder structured to decode the first to $j^{th}$ counting voltages to output the first to $k^{th}$ voltages, wherein k is $2^j$.

5. The data driver of claim 4, wherein the second enabling signal is a signal converted from the first enabling signal.

6. The data driver of claim 5, wherein the slew rate increases as a rising time of the analog data voltage decreases, and the count number increases as the slew rate decreases.

7. The data driver of claim 4, wherein the j-bit counter is a 4-bit counter.

8. The data driver of claim 1, wherein the latch comprises:

a second end gate structured to receive the first enabling signal and the output start signal to output a second control signal; and a latch structured to latch the first to $k^{th}$ voltages output from the counter, wherein k is equal to 16, and structured to output the first to $16^{th}$ voltages sequentially based on the output start signal.

9. The data driver of claim 8, wherein the output start signal is generated in a high period of the first enabling signal, and the first clock is generated before the output start signal is generated.

10. The data driver of claim 1, wherein the bias circuit comprises:

a first NMOS transistor and a second NMOS transistor which are arranged in a current mirror form; and a resistance provided between an output terminal of the first NMOS transistor and a ground voltage terminal, the resistance structured to adjust the voltage level of the at least one bias voltage responsive to the first to $k^{th}$ switching voltage.

11. The data driver of claim 10, wherein the resistance comprises:

first to $k^{th}$ resistive elements coupled to each other in series; and first to $k^{th}$ switches coupled to the first to $k^{th}$ resistive elements respectively, the first to $k^{th}$ switches coupling the corresponding resistive elements to the output terminal of the first NMOS transistor responsive to the first to $k^{th}$ switching voltages, respectively.

12. The data driver of claim 11, wherein sizes of each of the first to $k^{th}$ resistances are equal to each other, and a total resistance value of the resistance decreases as the count number of the comparison voltage increases.

13. A display apparatus comprising:

a timing control structured to output at least one image data signal in digital form, a gate control signal, and a data control signal;

a gate driver electrically coupled to the timing control and structured to generate gate voltages responsive to the gate control signal;

a data driver electrically coupled to the timing control and structured to output data voltages responsive to the data control signal; and a display electrically coupled to the gate driver and the data driver and structured to display an image corresponding to the data voltage responsive to the gate voltage, wherein the data driver includes:

an input circuit structured to receive at least one external digital image data signal;

a converter electrically coupled to the input circuit and structured to receive the at least one image data signal from the input circuit, and to convert the at least one image data signal into at least one analog data voltage;

an output buffer circuit electrically coupled to the converter and structured to receive the analog data voltage from the converter, and to buffer the analog data voltage responsive to at least one bias voltage;

a bias voltage control circuit electrically coupled to the output buffer; and a feedback path between the output buffer circuit and the bias voltage control circuit, wherein the bias voltage control circuit is structured to receive the analog data voltage from the output buffer circuit, to compare the analog data voltage with a predefined reference voltage so as to count a slew rate of the analog data voltage, and to vary a voltage level of the at least one bias voltage based on the counted result of the slew rate, and wherein the bias voltage control circuit comprises:

a comparator structured to compare the analog data voltage and the reference voltage responsive to a first clock and a first enabling signal, and to output a comparison voltage corresponding to the compared result;

a first level shifter structured to level down the comparison voltage;

a counter structured to receive the leveled down comparison voltage, to count a number of a high period of the comparison voltage responsive to a second clock and a second enabling signal, and to output first to $k^{th}$ voltages corresponding to a count number;

a latch structured to latch the first to $k^{th}$ voltages output from the counter responsive to an output start signal and the first enabling signal;

a second level shifter structured to level up the first to $k^{th}$ voltages output from the latch to output first to $k^{th}$ switching voltages; and a bias circuit structured to control a voltage level of the at least one bias voltage responsive to the first to $k^{th}$ switching voltages, and to feedback the at least one bias voltage to the output buffer circuit.

14. The display apparatus of claim 13, wherein the gate voltages are sequentially generated.

15. The display apparatus of claim 13, wherein the first clock is generated in a high period of the first enabling signal, and the first clock and the first enabling signal have an equal frequency level.

16. A data driver comprising:

an input circuit structured to receive at least one external digital image data signal;

a converter electrically coupled to the input circuit and structured to receive the at least one image data signal from the input circuit, and to convert the at least one image data signal into at least one analog data voltage;

an output buffer circuit electrically coupled to the converter and structured to receive the analog data voltage from the converter, and to buffer the analog data voltage responsive to at least one bias voltage;

a bias voltage control circuit electrically coupled to the output buffer; and a feedback path between the output buffer circuit and the bias voltage control circuit, wherein the bias voltage control circuit is structured to receive the analog data voltage from the output buffer circuit, to compare the analog data voltage with a predefined reference voltage so as to count a slew rate of the analog data voltage, and to vary a voltage level of the at least one bias voltage based on the counted result of the slew rate, wherein the bias voltage control circuit comprises:

a comparator structured to compare the analog data voltage and the reference voltage responsive to a first clock and a first enabling signal, and to output a comparison voltage corresponding to the compared result;

a first level shifter structured to level down the comparison voltage;

a counter structured to receive the leveled down comparison voltage, to count a number of a high period of the comparison voltage responsive to a second clock and a second enabling signal, and to output first to $k^{th}$ voltages corresponding to the count number;

a latch structured to latch the first to $k^{th}$ voltages output from the counter responsive to an output start signal and the first enabling signal;

a second level shifter structured to level up the first to $k^{th}$ voltages output from the latch to output first to $k^{th}$ switching voltages; and a bias circuit structured to control a voltage level of the at least one bias voltage responsive to the first to $k^{th}$ switching voltages, and to feedback the at least one bias voltage to the output buffer circuit, and wherein a voltage level of the at least one bias voltage is refreshed in a single frame unit by the bias voltage control circuit.

* * * * *